US005435581A

United States Patent [19]

Rosenfield

[11] Patent Number: 5,435,581

[45] Date of Patent: Jul. 25, 1995

[54] KIT TO CONVERT A CONVENTIONAL GOLF BAG TO A GOLF CART

[76] Inventor: Arthur M. Rosenfield, 20515 E. Country Club Dr., Aventura, Fla. 33180-3042

[21] Appl. No.: 240,137

[22] Filed: May 10, 1994

[51] Int. Cl.[6] ..... B62B 1/04

[52] U.S. Cl. ..... 280/30; 206/805; 280/47.18; 280/47.26; 301/111

[58] Field of Search ..... 280/47.26, DIG. 6, 47.18, 280/47.19, 30, 37, 43.1, 7.1, 7.12, 7.14, 7.17, 654, 43.24; 206/443, 805; 224/274, 42.01, 922, 913; 301/111; 16/45, 30

[56] References Cited

U.S. PATENT DOCUMENTS

| | | | |
|---|---|---|---|
| 1,955,463 | 4/1934 | Lathrop | 280/47.26 |
| 2,726,874 | 12/1955 | Sullivan | 280/37 |
| 4,686,745 | 8/1987 | Butler | 206/805 |
| 4,792,152 | 12/1988 | Carolan | 280/DIG. 6 |
| 4,836,565 | 6/1989 | Catalo | 280/DIG. 6 |
| 5,112,068 | 5/1992 | Liao et al. | 280/30 |

*Primary Examiner*—Anne Marie Boehler

[57] ABSTRACT

A golf bag with a kit to convert the manually carried golf bag to a pulled golf cart. An elastic band is attached to the base of the golf bag and receives a pair of wheels to add mobility to the bag when it is pulled by its attached strap.

7 Claims, 3 Drawing Sheets

KIT TO CONVERT A CONVENTIONAL GOLF BAG TO A GOLF CART

BACKGROUND OF THE INVENTION

This invention relates to a kit carried with a conventional golf bag along with the golf clubs and accessory equipment to convert a carried golf bag to a pulled golf cart.

The game of golf requires considerable equipment. This includes a number of special purpose golf clubs, golf balls, tees, and a wide variety of accessories. This equipemnt is carried in a golf bag which is an open topped elongated container provided with carrying straps. In the course of playing a round of golf, a golfer may have to carry his golf bag several miles. Depending upon the size of the golf bag and its equipment load, the total weight carried by the golfer can range from about 10 to 25 lbs. It can be seen that this comprises a substantial load when it is considered that it must be carried several miles.

Manually pulled golf carts are conventionally employed by golfers to carry a golf bag around the golf course. A typical pull cart is a simple two wheeled skeleton tubular structure provided with a pulling handle on one end and a collapsible frame on the other end to support the wheels. A stabilizer foot is mounted on the frame to permit the cart to remain in an upright position. While these carts function well and are widely used, nevertheless, they comprise an additional bulky piece of equipment that must be carried to and from the golf course and then pulled with the added load of the golf bag.

Many golfers prefer to be unencumbered by a pull cart and choose to carry the golf bag slung over the shoulder or directly by hand. Others prefer to have the option of carrying the golf bag, and when tiring to convert it to a wheeled pull cart.

A number of golf bags and carrying cases have been invented which incorporate structure to convert from a carrying mode to a wheeled mode. U.S. Pat. No. 5,112,068, issued May 12, 1992 to Henry H. Liao et al. shows a golf bag provided with an integral tubular cross piece at a bottom location to receive separately carried wheels and a support leg. When it is desired to convert the golf bag from a carried mode to a wheeled mode, the wheels and support leg are removed from the golf bag and inserted in the tubular cross piece. U.S. Pat. No. 4,836,565, issued to Irenee Catalo shows a carrying case to hold golf clubs and accessories which may be carried by an external handle. The case is provided with sockets to receive a pair of wheels and a handle to convert the case to a pulled cart.

While the above mentioned patents do teach converting a golf bag or case from a carried mode to a pulled mode, the prior art does not teach converting a conventional golf bag from a carried mode to a pulled mode without making any permanent modifications to the golf bag.

SUMMARY OF THE INVENTION

The overall object of the present invention is to improve upon the prior art golf bags by making it possible to convert a conventional golf bag from a carried mode to a pulled mode.

It is another object of the invention to supply a conventional golf bag with a kit carried with the golf bag which can be easily installed to convert the golf bag to a golf cart.

It is a specific object of the invention to provide the base of a conventional golf bag with an encircling resilient band which supports a pair of wheels in integral enlargements forming wheel supports.

It is yet another object of the invention to provide the encircling resilient band with external attachments to support a pair of wheels and a stabilizing foot.

DESCRIPTION OF THE PREFERRED EMBODIMENTS

Figure 1:
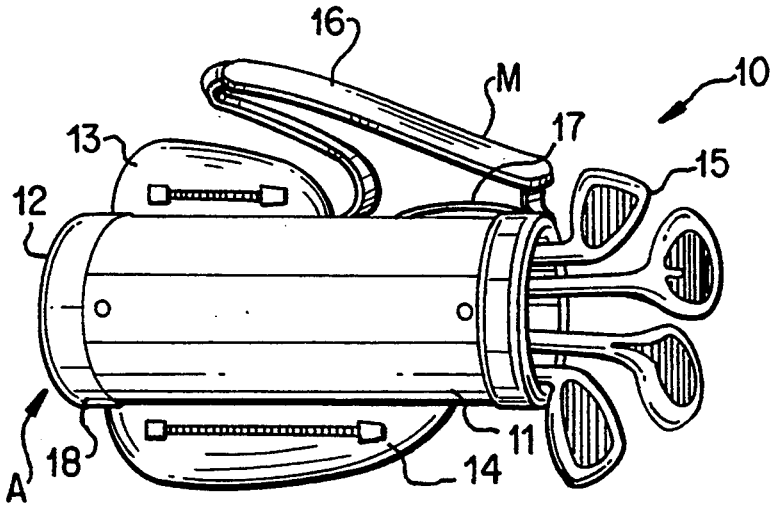
FIG. 1 is a side view of a typical golf bag.

Referring now in general to the drawings and in particular to FIGS. 1–4, a conventional manually carried golf bag 10 is shown comprising an open topped elongated container 11 having a closed bottom 12. The golf bag is built of leather, fabric, or plastic material or a combination thereof, and is generally circular in cross section. However, some golf bags employ an oval cross section. A number of pockets, shown here at 13 and 14 are attached to sides of the golf bag to hold golf balls, tees and other small accessories. The container itself carries a number of golf clubs 15. A shoulder strap 16 and a smaller hand grip 17 are attached to container 11 to carry it around the golf course. The structure described above is conventional in golf bag design.

The bottom portion of the golf bag surrounding the closed bottom 12 is reenforced with a number of layers of material to form a reenforcement collar 18 to add rigidity to the base. This rigidity is necessary to enable the golf bag to stand upright when placed on the ground and to prevent it from collapsing when placed on its side. In some designs, an integrally molded closure cap serves the dual function of capping off the bottom of container 11 and at the same time serving as a reenforcing collar 18.

Figure 2:
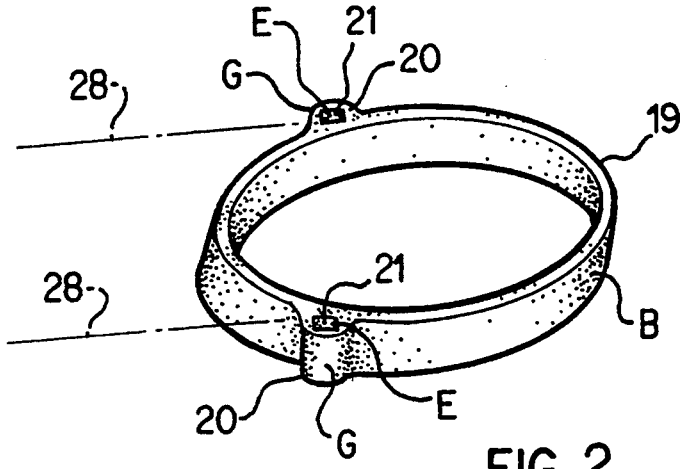
FIG. 2 is a perspective view of the elastic supporting band.
Figure 3:
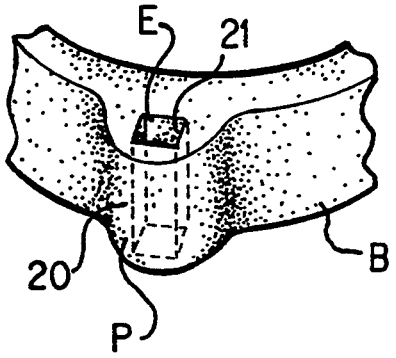
FIG. 3 is an enlarged view of one of the projections on the elastic band to support a wheel.

The reenforcing collar receives an elastic band 19 as shown in FIG. 2. Band 19 is formed of any suitable plastic material having the elastic properties of natural rubber and the requisite chemical and physical properties to resist deterioration due to the elements, and the property to maintain its elasticity over time. Integrally molded or physically bonded to the outer periphery of the elastic band are two spaced axle supporting enlargements 20 shown in FIGS. 2 and 3. Each enlargement 20 is provided with an opening 21, preferably square or rectangular in shape, to support a pair of axles to be described below.

Figure 4:
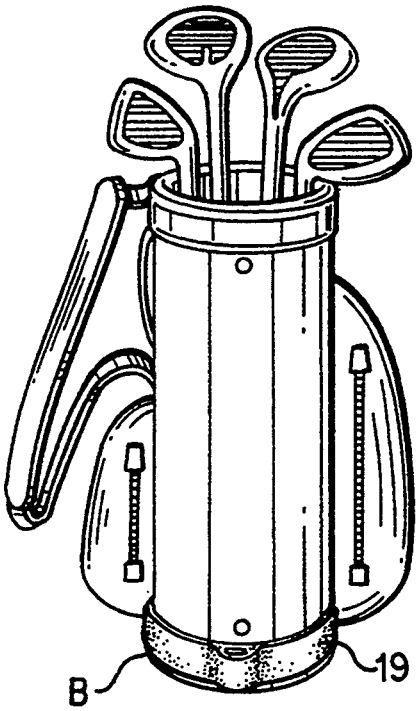
FIG. 4 is a side view showing the elastic band of FIG. 2 mounted on the base of the golf bag.

Elastic band 19 is stretched and placed in position over reenforcing collar 18 as shown in FIG. 4. The diameter or peripheral extent of elastic band 19 is made less than the diameter or peripheral extent of collar 18 so that when stretched to elastically embrace the collar it will be retained with sufficient elasticity to form a friction fit around the collar. These matters are determined through experimentation and depend upon the physical properties of the material employed in the elastic band. While an elastic band to fit an 8–9 inch diameter golf bag base is anticipated as being the most common application, elastic bands of different sizes can be supplied to fit most golf bags in use today.

Figure 5:
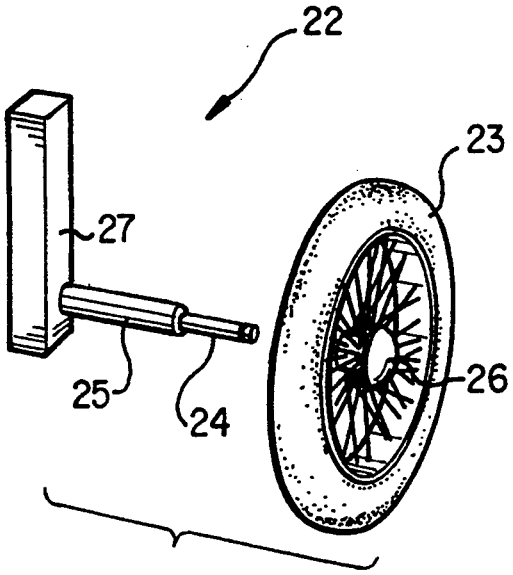
FIG. 5 shows a wheel and its axle support for mounting on the elastic band.
Figure 6:
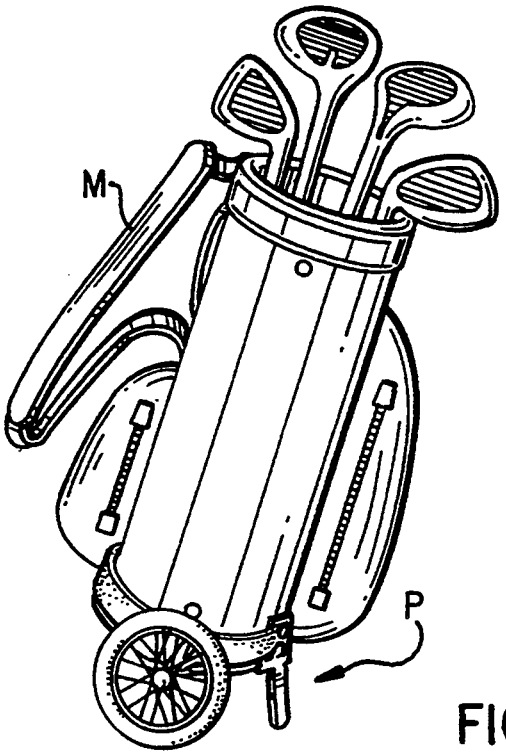
FIG. 6 is a perspective view showing the wheels attached to the golf bag.

The openings 21 in axle supporting enlargements 20 receive a wheel and axle assembly 22 shown in FIG. 5. The assembly comprises a wheel 23 mounted on the reduced end 24 of an axle 25. Wheel 23 is trapped on the reduced end of the axle by means of a slip nut 26. The axle 25 is rigidly joined to a stub shaft 27, here shown as rectangular in cross section, to extend in an approximate right angular relationship. As shown in FIG. 6, a stub shaft 27 is inserted in each opening 21 in a tight frictional fit to support the golf bag on a pair of wheels.

Referring to FIGS. 2 and 6, the axle supporting enlargements 20 are arcuately angled less than 180 degrees and face in the direction of the shoulder strap 16. The purpose in spacing the enlargements 20 at an arcuate angle less than 180 degrees is to reduce the size of the wheels necessary to support the golf bag over the ground as can be seen in examining FIG. 6.

Figure 7:
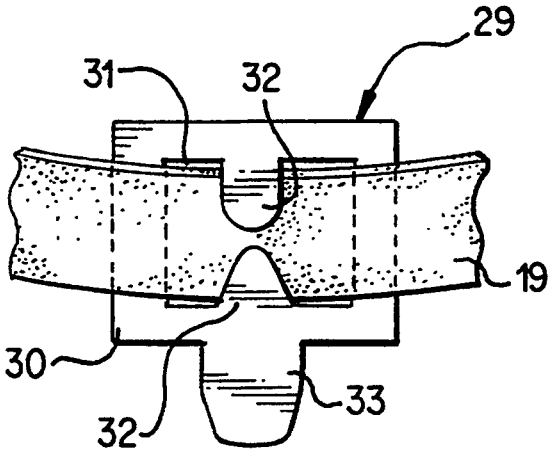
FIG. 7 shows a stabilizer foot mounted on the elastic band.

Referring to FIG. 7, a stabilizing foot 29 is attached to the elastic band 19 at a location symmetrically opposite the enlargement openings 21 to maintain the golf bag in a vertical position. The foot 29 forms a three point support with the wheels 23 as can be ascertained from FIG. 6 when the golf bag is rotated to a vertical position. It should be noted that mounting the wheels off center facing the shoulder strap improves the three point stability.

Foot 29 may be formed of a sheet metal stamping or can be molded of plastic and comprises a backing plate 30 with a generally rectangular opening 31. A pair of tabs 32 extend partially across opening 31 to grip the elastic band 19 when it is elastically fed between the tabs. A ground engaging projection 33 extends from the backing plate to complete the assembly.

In operation, the basic kit comprising elastic band 19, two wheel and axle assemblies 22 and stabilizing foot 29 are attached to the golf bag in the following sequence. The stabilizing foot 29 is installed on the elastic band 19 by feeding the band into the space between the tabs 32. The elastic band is then stretched over the reenforcing collar 18 with the axle supporting enlargements 20 symmetrically facing the shoulder strap 16. A stub shaft 27 of each wheel and axle assembly is inserted in an opening 21. Circular band 19 and stabilizing foot 29 are adjusted as needed. By pulling on the strap 16 or grip 17 the golf bag rotates to a wheeled position where it now functions as a pull cart.

Figure 8:
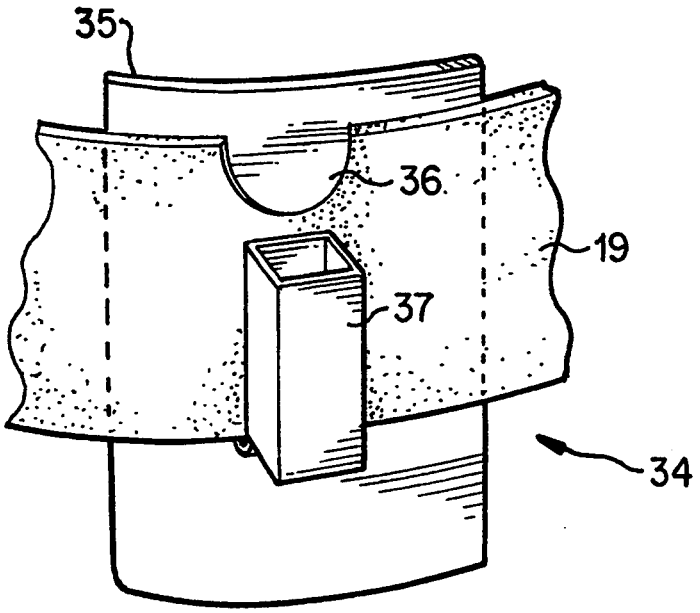
FIG. 8 shows a modified wheel support.

While the above described invention comprises a preferred embodiment, it is clear that the invention is susceptible to many modifications. For example, the integral axle supporting enlargements 20 can be replaced with stamped or molded axle supporting plates such as shown at 34 in FIG. 8. Each axle supporting plate 34 comprises a backing plate 35 having an integral tab 36 spaced slightly forward to receive elastic band 19. Opposite the tab 36 is a small section of rectangular tubing 37 having a base portion attached to plate 35. The band is captured between the tab 36 and rectangular section 37. The stub shaft 27 is inserted within rectangular section 37. In all other respects, this modification functions in the same manner as band 19 discussed above.

It is not intended to limit the present invention to the details of illustration or terms of description of the embodiments shwon above. It will be appreciated by those ski 11 ed in the art that various modifications and alterations therein may be made within the scope of the present invention.

What is claimed is:

1. A golf bag comprising an elongated container having an open top and a closed bottom, a collar integrally attached to and extending from said closed bottom and surrounding a portion of said elongated container to reenforce same above said closed bottom, a carrying strap affixed to said elongated container at an upper side portion, a closed integrally formed, elastic band tightly secured around said collar in hoop tension, wheel support means on said flexible band at two spaced locations, a shaft receiving hole in each said wheel support means, a stub shaft frictionally and non-rotationally held in each said shaft receiving hole, an axle extending from each said stub shaft and a wheel mounted on each said axle whereby said golf bag can function as a golf cart when pulled by said strap.

2. The apparatus as claimed in claim 1 including a stabilizing foot mounted on said elastic band at a location on said container side opposite said container side to which said strap is affixed.

3. The apparatus as claimed in claim 2 wherein said wheel support means on said elastic band is spaced at an arcuate angle less than 180 degrees facing in the direction of the carrying strap.

4. The apparatus as claimed in claim 3 wherein said wheel support means comprises two spaced enlargements integrally formed on said elastic band.

5. The apparatus as claimed in claim 1 wherein said wheel support means comprises a pair of spaced wheel supporting plates attached to said elastic band, each of said plates comprising an upper tab extending over a top portion of said elastic band, a section of tubing secured to a bottom portion of said plate, said tubing extending over said elastic band and serving as a shaft receiving hole.

6. The apparatus as claimed in claim 2, wherein said stabilizing foot comprises a backing plate positioned between said collar and elastic band, a pair of tabs extending from said backing plate to overlie and secure said elastic band; and a ground engaging projection extending from said plate.

7. The apparatus as claimed in claim 1 wherein said shaft receiving hole is noncircular in shape and oriented with respect to the elastic band support the wheels in parallel relationship.

* * * * *